United States Patent [19]

Inoue et al.

[11] Patent Number: 4,971,584

[45] Date of Patent: Nov. 20, 1990

[54] WATER JET PROPELLING VESSEL

[75] Inventors: Seiji Inoue; Ryoichi Nakase, both of Hamamatsu, Japan

[73] Assignee: Sanshin Kogyo Kabushiki Kaisha, Hamamatsu, Japan

[21] Appl. No.: 324,561

[22] Filed: Mar. 16, 1989

[30] Foreign Application Priority Data

Mar. 17, 1988 [JP] Japan ..... 63-64432

[51] Int. Cl.[5] ..... B63H 11/08; B63H 11/113

[52] U.S. Cl. ..... 440/38; 114/270; 440/42; 440/46; 440/47

[58] Field of Search ..... 114/270; 60/221; 440/38, 40–43, 46, 47

[56] References Cited

U.S. PATENT DOCUMENTS 3,839,859 10/1974 Woell, Jr. ..... 440/38 X
4,073,257 2/1978 Rodler, Jr. ..... 440/40
4,541,808 9/1985 Ono et al. ..... 440/42
4,902,254 2/1990 Chas ..... 440/38

FOREIGN PATENT DOCUMENTS 53-21197 6/1978 Japan .
60-26179 8/1985 Japan .

*Primary Examiner*—Sherman Basinger
*Attorney, Agent, or Firm*—Ernest A. Beutler

[57] ABSTRACT

Several embodiments of jet propelled water vessels wherein the bull and jet propulsion unit cooperate to form an inlet opening so that the outer housing of the jet propulsion unit need not itself form the inlet. This facilitates servicing since the water inlet need not be removed along with the jet propulsion unit for servicing and minimizes the likelihood of damage to the inlet duct and support for the impeller shaft.

9 Claims, 6 Drawing Sheets

*Figure 8*
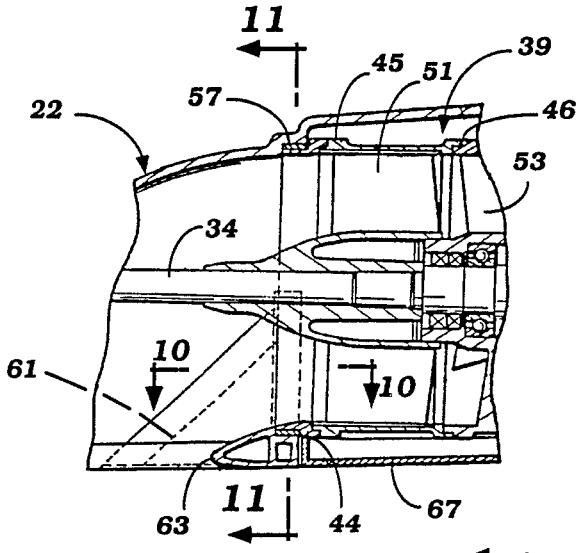
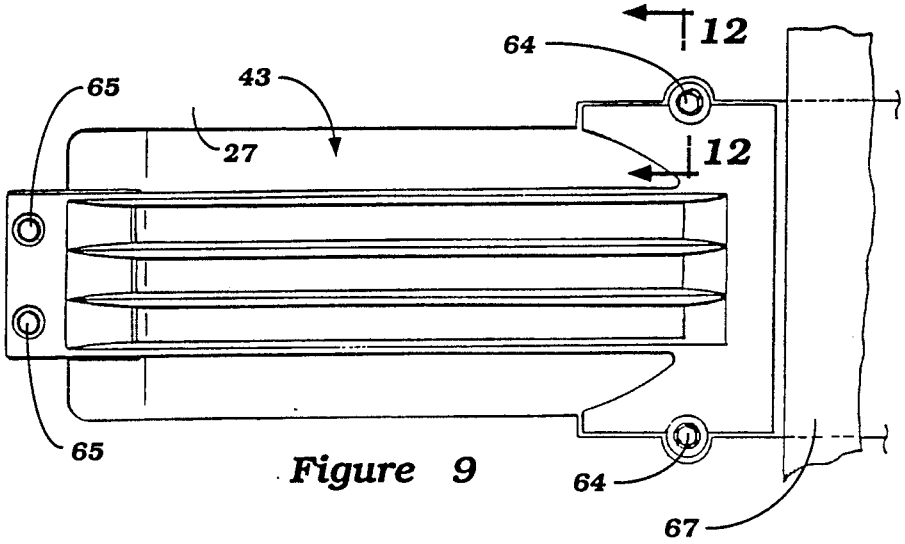
*Figure 9*

Figure 13
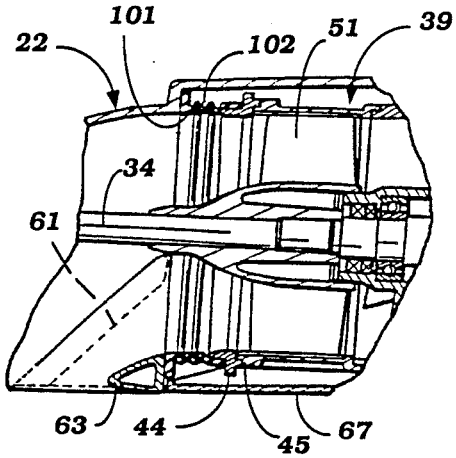
Figure 15
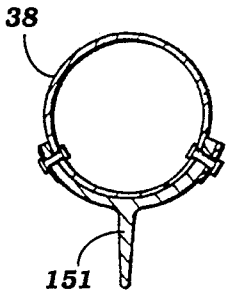
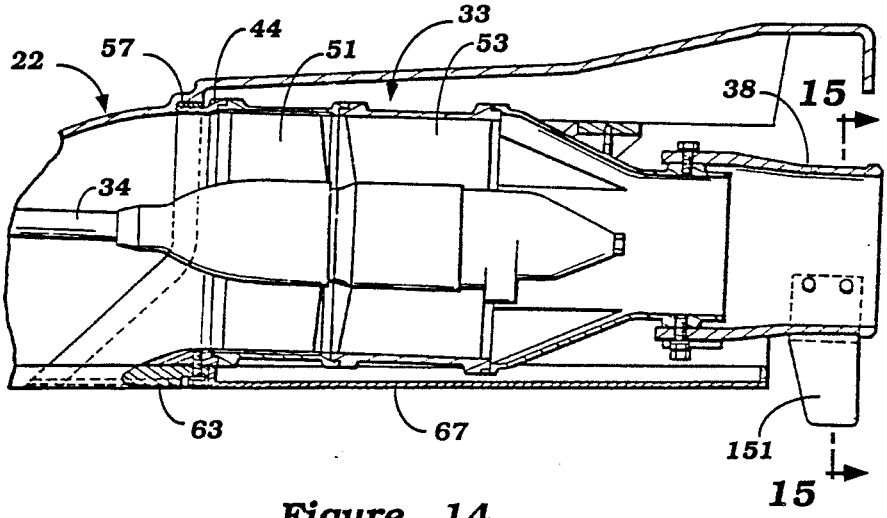
Figure 14

WATER JET PROPELLING VESSEL

BACKGROUND OF THE INVENTION

This invention relates to a water jet propelling vessel and more particularly to an improved arrangement for mounting and operating the jet propulsion unit of such a vessel.

One popular form of watercraft is that of the jet propulsion type. This type of watercraft generally has a hull that is formed with a longitudinally extending tunnel in the rear portion of the hull. A jet propulsion unit, consisting of an outer housing that defines a water inlet, an impeller housing in which an impeller is supported and a dischage nozzle are supported within the tunnel. The impeller is driven by an engine that is positioned forwardly in the watercraft by means of an impeller shaft that extends through the tunnel to the jet propulsion unit. Although this type of vessel has a number of advantages, the mounting of the jet propulsion unit rearwardly of the driving engine can present some difficulties.

One particular problem with this type of unit is that the water inlet and housing in which the impeller casing are formed are a unitary assembly that must be removed as such when the propulsion unit is being serviced. As a result, this necessitates removal of the water intake duct every time the propulsion unit is serviced. Of course, it is desirable to insure that the intake duct is adequately sealed around the tunnel area so that water cannot inadvertently pass into the tunnel rather than through the inlet and also to avoid any leakage in this area. The flow resistance of such an arrangement would be unacceptable and, furthermore, the efficiency of the total unit may be adversely affected. In addition, the prior art types of arrangements can cause distortion or damage to the watercraft hull or inlet duct upon assembly and disassembly.

It is, therefore, a principal object of this invention to provide an improved water jet propelling vessel and an arrangement for mounting and driving the jet propulsion unit in the hull of the watercraft.

It is a further object of this invention to provide an improved hull arrangement and cooperating jet propulsion unit for a water vessel of this type.

SUMMARY OF THE INVENTION

This invention is adapted to be embodied in a jet propeller water vehicle that is comprised with a hull formed with a tunnel like recess extending longitudinally at the rear end of the hull. A jet propulsion unit is mounted within the hull tunnel rearwardly of the front edge thereof to define a forwardly positioned water inlet part having a downwardly facing inlet opening. The jet propulsion unit is comprised of an outer housing that defines a generally annular inlet opening that communicates with the tunnel inlet port to receive water therefrom. An impeller is journaled within the outer housing for drawing water through the inlet port and expelling water to power the vehicle.

BRIEF DESCRIPTION OF THE DRAWINGS

FIG. 8 is a cross-sectional view, in part similar to FIG. 2, but shows only the forward portion of the jet propulsion unit and the supporting portion of the hull of a second embodiment of the invention.

FIG. 9 is a bottom plan view showing the water inlet.

FIG. 13 is a partial cross-sectional view, in part similar to FIGS. 2 and 8 and showing substantially the same portion as shown in FIG. 8 of another embodiment of the invention.

FIG. 14 is a cross-sectional view, in part similar to FIG. 12, showing a fourth embodiment of the invention.

FIG. 15 is a cross-sectional view taken along the line 15—15 of FIG. 14.

DETAILED DESCRIPTION OF THE PREFERRED EMBODIMENTS OF THE INVENTION

Figure 1:
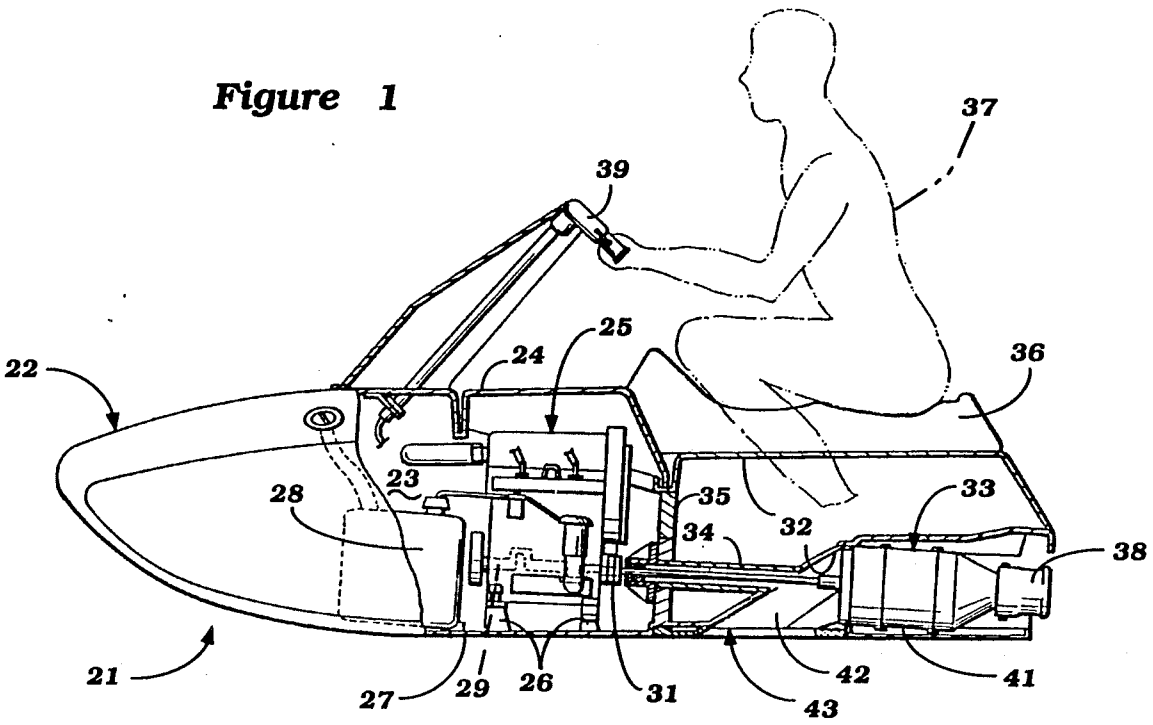
FIG. 1 is a side elevational view of a small jet propelled watercraft constructed in accordance with a first embodiment of the invention, with a portion broken away to more clearly show the construction.
Figure 2:
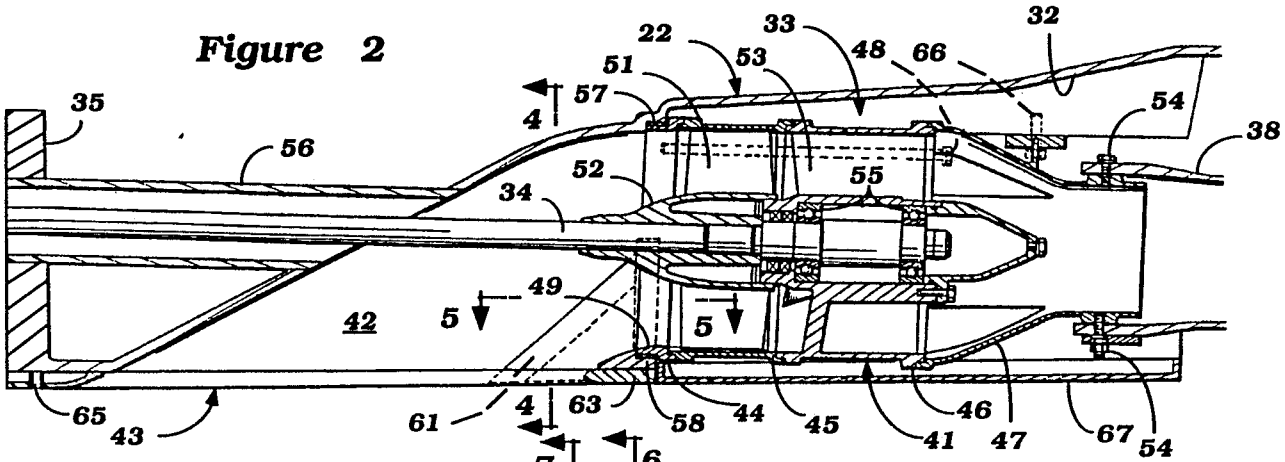
FIG. 2 is an enlarged cross-sectional view taken through the jet propulsion unit and the mounting arrangement therefor in the hull.
Figure 3:
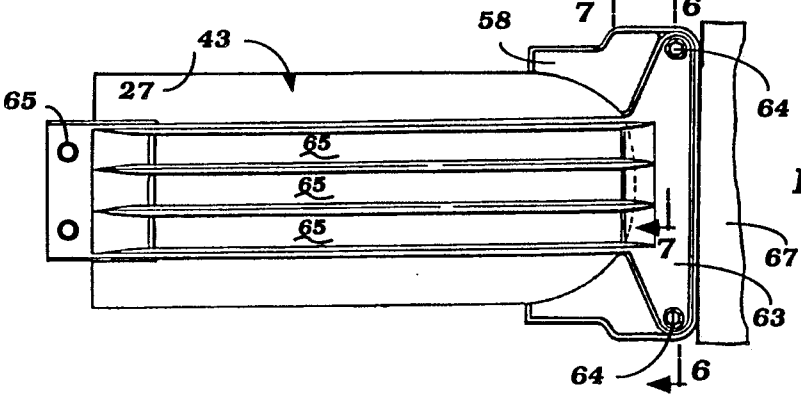
FIG. 3 is a bottom plan view showing the water inlet opening for the jet propulsion unit.
Figure 4:
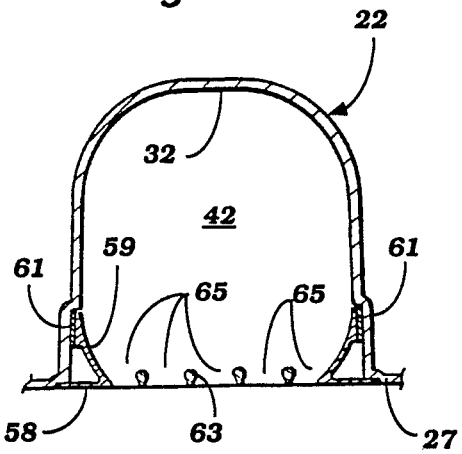
FIG. 4 is a cross-sectional view taken along the line 4—4 of FIG. 2.
Figure 5:
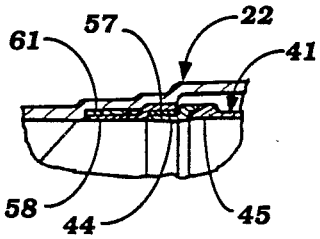
FIG. 5 is a cross-sectional view taken along the line 5—5 of FIG. 2.
Figure 7:
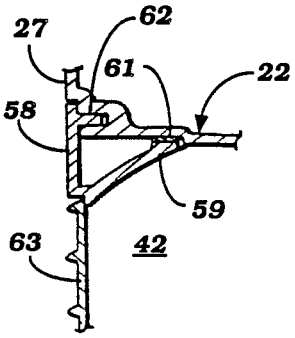
FIG. 7 is a cross-sectional view taken along the line 7—7 of FIG. 3.
Figure 6:
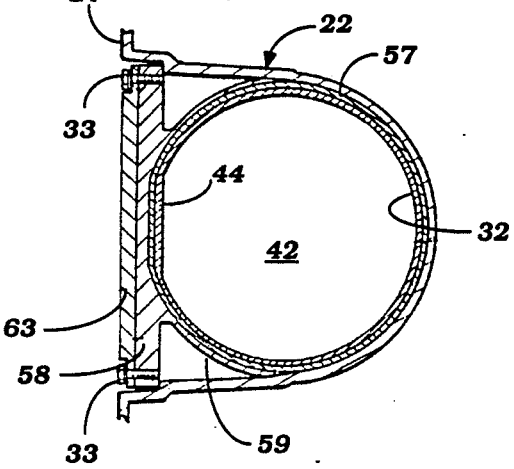
FIG. 6 is a cross-sectional view taken along the line 6—6 of FIG. 3.
Figure 10:
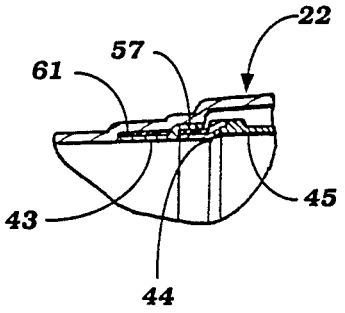
FIG. 10 is a cross-sectional view taken along the line 10—10 of FIG. 8.
Figure 11:
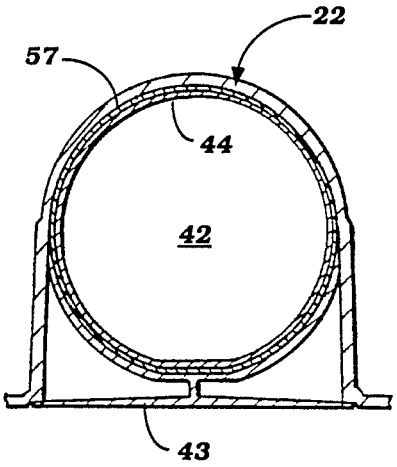
FIG. 11 is a cross-sectional view taken along the line 11—11 of FIG. 8.
Figure 12:
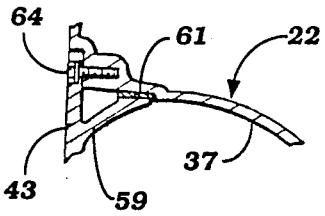
FIG. 12 is a cross-sectional view taken along the line 12—12 of FIG. 8.

Referring now in detail to the drawings and initially to FIG. 1, a small watercraft constructed in accordance with an embodiment of the invention is identified generally by the reference numeral 21. In the illustrated embodiment, the watercraft is of the type that is designed to be operated by a single rider sitting in straddle fashion on the watercraft. Although the invention has particular utility in conjunction with such types of watercraft, it is to be understood that the invention can be utilized with other types of jet propelled watercraft than that illustrated.

The watercraft 21 is comprised of hull, indicated generally by the reference numeral 22 and which may be formed from fiberglass reinforced molded resin or the like. The hull 22 is provided with a forward engine compartment 23 that is closed by means of a removable hatch cover 24. An internal combustion engine, indicated generally by the reference numeral 25 and which may be of any known type is mounted within the engine compartment 23 by means of a plurality of engine mounts 26 that are affixed in a suitable manner to the lower wall 27 of the hull 22. A fuel tank 28 is positioned forwardly of the engine 25 in the engine compartment 23.

The engine 25 may be of any known type and is depicted as being of the two cylinder, in-line, crankcase compression, two cycle type. There is a crankshaft 29 that is journaled for rotation about a generally longitudinally extending axis and which drives a coupling 31.

A tunnel, indicated generally by the reference numeral 32 is formed centrally in the underside of the hull lower wall 27 rearwardly of the engine compartment 23. A jet propulsion unit 33 is mounted within the tunnel 32 in a manner to be described. The jet propulsion unit 33 is driven by means of a propeller shaft 34 that extends forwardly through a bulkhead 35 of the hull 22 and which is connected to the coupling 31 in a known manner.

A seat 36 is formed over the tunnel portion 32 and accommodates a single rider seated in straddle fashion, as aforenoted, as indicated at 37.

The jet propulsion unit 33 has a steerable discharge nozzle 38 that is steered by means of a handlebar assembly 39 positioned forwardly of the seat 36 and coupled to the steering nozzle 38 in a known manner for effecting its steering. The construction of the watercraft 22 as thus far described may be considered to be conventional.

However, in accordance with the invention, an outer housing assembly, indicated by the reference numeral 41, of the jet propulsion unit 33 cooperates with the forward portion of the tunnel 32 to define an inlet part 42. An inlet screen 43 is positioned over the bottom end of the inlet part 42 for screening large foreign articles from the incoming water.

The construction of the mounting of the housing unit 41 within the tunnel 32 and the formation of the inlet part in accordance with the various embodiments of the invention will now be described by detailed reference to the remaining figures with the embodiment of FIGS. 2 through 7 being described first.

The outer housing 41 of the jet propulsion unit 33 is comprised of three generally annular sections. These comprise a relatively short inlet section 44, a somewhat longer impeller section 45, a straightening vane 46 and a discharge nozzle section 47. The sections 44, 45, 46 and 47 are all held together by means of elongated bolts 48 that pass through apertures in the sections 45, 46 and 47 and which are threaded into appropriately tapped openings in the section 44. It should be noted that unlike prior art constructions, the section 44 has a generally forwardly facing inlet opening 49 that communicates directly with the inlet portion 42 formed by the tunnel 32 forwardly of the outer housing 41. This inlet opening is generally annular, except is flattened at its lower edge at the forward end as clearly shown in FIG. 6. The sections 44, 45, 46 and 47 have at their mating edges tongue- and groove-like joints so as to insure adequate sealing.

An impeller 51 has a hub portion 52 that is affixed to the propeller shaft 34 for driving the impeller 51 and drawing water from the inlet part 42 for discharge into the section 46 wherein straightening vanes 53 are supported. After being straightened, the water is discharged through the discharge nozzle section 48 into the pivotally suported steering nozzle 38 which is journaled on the discharge nozzle portion 47 by means of a pair of bolts 54.

The section 46 is formed with an internal hub part that supports a pair of antifriction bearings 55 for journaling the rear end of the propeller shaft 34. It should be noted that the propeller shaft 34 extends through the inlet part 42 and through an annular tubular section 56 of the hull 22 for sealing purposes. A suitable seal (not shown) may be formed at the forward portion of the bulkhead 35 for sealing purposes.

A generally annular seal 57 encircles the forwardmost part of the housing portion 44 and is sealingly engaged in a corresponding recess formed in the hull 22 around the upper portion of the tunnel 32. At its lower end, the seal 57 is held in sealing engagement with the jet propulsion unit housing portion 44 by means of a combined duct former and support member 58. The member 58 has an arcuate forwardly extending portion 59 that is sealingly engaged with a seal 61 for sealing the sides of the tunnel 32. There also may be provided upwardly extending ridges 62 (FIG. 7) at opposite sides of the duct forming and supporting member 58 so as to provide a further tongue and groove seal around the inlet opening to the inlet passage 42. This also adds to the rigidity of the hull.

A strainer plate, indicated generally by the reference numeral 63 is affixed to the underside of the hull lower wall 27 by means of rearward fasteners 64 which also serve to hold the duct forming and supporting member 58 in position. The strainer member 64 is formed with a plurality of longitudinally extending inlet openings 65 that communicate with the inlet part 42 to form water admission therefor. At the forward end, the screen member 63 is held in place by means of threaded fasteners 65.

The rear end of the jet propulsion unit 33 is supported by means of threaded fasteners 66 that are screwed into appropriate receivers in the hull underside 27 around the tunnel 32. The lower portion of this part of the tunnel 32 is closed by means of a closure plate 67 that is held in place in any suitable manner.

It should be readily apparent that the jet propulsion unit 33 may be conveniently serviced by removing the closure plate 67 and with the supporting bolt 66 so as to draw the jet propulsion unit 33 rearwardly from the tunnel. The inlet duct part need not be removed since it, in effect, forms a part of the hull although the fasteners 64 and 65 may be loosened for the purpose of servicing. Hence, the servicing is facilitated and there is no likelihood of distortion for the inlet duct which is formed by the hull.

FIGS. 8 through 12 show another embodiment of the invention which is generally similar to the embodiment of FIGS. 1 through 7. The only difference between this embodiment and the previously described embodiment is that in this embodiment, the duct forming and supporting member 58 and the screen member 63 are combined into a single piece. Because of this similarity, the components which are the same or substantially the same have been identified by the same reference numerals and a further description of this embodiment in not believed to be necessary to permit those skilled in the art to know and utilize the construction.

In the two embodiments of the invention as thus far described, the inlet portion 44 of the jet propulsion unit outer housing 41 has been sealed to the hull by means of an annular compression seal 57. FIG. 13 shows another embodiment of the invention which is generally similar to the embodiments previously disclosed. In this embodiment, however, the housing inlet portion 44 terminates short of a forward shoulder 101 formed by the hull 22. A bellows type seal 102 embodying an internal coil compression spring engages the housing portion 44 and effects the seal with this shoulder 101. The remaining construction of this embodiment may be either the same as the embodiment of FIGS. 1 through 7 or the embodiment of FIGS. 8 through 12 and, for that reason, further description of this embodiment is not believed necessary to permit those skilled in the art to utilize the invention.

FIGS. 14 and 15 show another embodiment which, for the most part, may take the construction as any of the preceding described embodiments. In this embodiment, however, the steering nozzle 38 is provided with a rudder part 151 that extends below the plate 67 and thus will provide some rudder like steering in addition to the jet propulsion nozzle steering effect.

It should be readily apparent from the foregoing description that a number of embodiments of the invention have been illustrated and described, each of which provides a very effective housing assembly for a jet propelled watercraft wherein the hull of the watercraft itself cooperates with the jet propulsion unit to provide its support and also so as to form the water inlet portion for it. Although a number of embodiments of the invention have been illustrated and described, various changes and modifications may be made without departing from the spirit and scope of the invention, as defined by the appended claims.

We claim:

1. A jet propelled water vessel comprised of a hull forming a tunnel like recess extending longitudinally at the rear of said hull and opening through the rear end thereof, a jet propulsion unit mounted within said hull tunnel rearwardly from the front edge thereof with the forward portion of said tunnel defining a forward positioned water inlet port having a downwardly facing inlet opening, said jet propulsion unit comprising an outer housing defining a generally annular inlet opening communicating with said tunnel inlet port to receive water therefrom, seal means interposed between said outer housing and said hull tunnel portion for sealing against water leakage between said water inlet port and said outer housing inlet opening said seal means being contiguous to the front end of said outer housing inlet opening, and an impeller journaled within said outer housing for drawing water through said tunnel inlet port and expelling said water to power said vessel.

2. A jet propelled water vessel as set forth in claim 1 wherein the jet propulsion outer housing annular inlet opening faces longitudinally of the watercraft.

3. A jet propelled water vessel as set forth in claim 2 wherein the forward portion of the jet propulsion unit outer housing is supported by means of a duct forming member fixed to the hull.

4. A jet propelled water vessel as set forth in claim 3 wherein the duct forming member also has an integral screen portion extending across the inlet opening to preclude the ingress of large foreign articles.

5. A jet propelled water vessel as set forth in claim 4 further including seal means interposed between the jet propulsion unit outer housing and the hull for sealing the annular inlet opening of the outer housing relative to the hull.

6. A jet propelled water vessel as set forth in claim 5 wherein the seal means comprises a compression seal interposed between the outer housing inlet opening portion and the hull.

7. A jet propelled water vessel as set forth in claim 5 wherein the seal means comprises a bellows type seal interposed between the outer housing of the jet propulsion unit and the hull.

8. A jet propelled water vessel as set forth in claim 3 wherein the seal means comprises a compression seal interposed between the outer housing inlet opening portion and the hull.

9. A jet propelled water vessel as set forth in claim 3 wherein the seal means comprises a bellows type seal interposed between the outer housing of the jet propulsion unit and the hull.

* * * * *